United States Patent [19]

Den Herder et al.

[11] 3,981,813

[45] Sept. 21, 1976

[54] HYDRAULIC FLUID

[75] Inventors: Marvin J. Den Herder, Olympia Fields; Thomas Martin Warne, Wheaton, both of Ill.

[73] Assignee: Standard Oil Company (Indiana), Chicago, Ill.

[22] Filed: May 12, 1975

[21] Appl. No.: 576,362

[52] U.S. Cl. ..... 252/75; 252/73; 252/76

[51] Int. Cl.[2] ..... C10M 1/40

[58] Field of Search ..... 252/75, 76, 79, 56 D, 252/33.2, 33.4, 74, 73

[56] References Cited

UNITED STATES PATENTS

| | | | |
|---|---|---|---|
| 3,288,714 | 11/1966 | Osuch | 252/56 D X |
| 3,378,494 | 4/1968 | Berger | 252/79 X |
| 3,382,172 | 5/1968 | Lowe | 252/56 D X |
| 3,396,114 | 8/1968 | Vienna et al. | 252/75 |
| 3,629,119 | 12/1971 | Weaver | 252/79 X |
| 3,679,588 | 7/1972 | Schaap et al. | 252/75 |
| 3,775,319 | 11/1973 | Hartman | 252/75 X |
| 3,843,542 | 10/1974 | Adams | 252/76 X |
| 3,872,048 | 3/1975 | Brown | 252/76 X |

*Primary Examiner*—Harris A. Pitlick
*Attorney, Agent, or Firm*—James R. Henes; Arthur G. Gilkes; William T. McClain

[57] ABSTRACT

A hydraulic fluid comprising a major proportion of a hydrocarbon oil having a viscosity of about 10–200 centistokes at 100°F. and a minor proportion of a metal sulfonate, a higher molecular weight alkyl- or alkenyl-succinic acid or anhydride, a lower molecular weight alkyl- or alkenyl-succinic acid or anhydride, a nonionic emulsifier, and a hindered hydrocarbyl phenol.

18 Claims, No Drawings

HYDRAULIC FLUID

BACKGROUND OF THE INVENTION

1. Field of the Invention

The present invention pertains to natural or synthetic hydrocarbon oils containing additives that are used as hydraulic fluids in systems that may become contaminated with sea water, such as in ships, submarines, diving rigs, underwater hydraulic tools, and the like. In particular, the present invention pertains to a hydraulic fluid comprising a natural or synthetic hydrocarbon oil solution containing a metal sulfonate, a higher molecular weight alkyl— or alkenyl-succinic acid or anhydride, a lower molecular weight alkyl— or alkenyl-succinic acid or anhydride, a nonionic emulsifier, and a hindered hydrocarbyl phenol.

2. Description of the Prior Art

Hydraulic fluids which are used in such hydraulic power applications as in ships, submarines, diving rigs, underwater hydraulic tools, and the like, may become contaminated with sea water. A fluid is needed which will continue to function in these systems in the presence of sea water, for example, even up to 50 volume percent of sea water in the oil, and which will protect these systems from corrosion and deterioration caused by the sea water or the salts therein. Such fluid must form a tight sea water-in-oil emulsion, provide hydrolytic stability, oxidation resistance, protection against rust, corrosion and wear, and continue to perform as a power transmission fluid without forming sludge or varnish, when contaminated by sea water, as provided in "Military Specification — Hydraulic Oil, Non-corrosive — Sea Water Emulsifying," published May 24, 1972 under the code MIL-H-24430A (SHIPS).

Known compounded hydrocarbon oils used as hydraulic fluids have been unsatisfactory in their ability to form tight sea water-in-oil emulsions or have been hydrolytically unstable so that rusting, corrosion, or other damage to the hydraulic systems occurred. In particular, the hydraulic fluid described in U.S. Pat. No. 3,679,588, whose composition is similar to the composition of the present invention, does not meet all the current specifications in MIL-H-24430A (SHIPS). The hydraulic fluid of U.S. Pat. No. 3,679,588 employs the condensation product of a monoalkyl phenol, tetraethylene pentamine, and formaldehyde as an emulsifier. However, this condensation product is potentially corrosive to brass- and copper-containing materials. Therefore, the hydraulic fluid of U.S. Pat. No. 3,679,588 also contains N,N'-dimethyldithiooxamide which is a film-forming metal-deactivator and serves to protect brass against corrosion caused by the condensation product. However, N,N'-dimethyldithio-oxamide tends to cause formation of surface film which may cause sticking of valves and servo-mechanisms. Further, the N,N'-dimethyldithio-oxamide film may be removed under conditions of high wear, and the unprotected brass surface would then be exposed to the corrosive condensation product. The components of the present invention eliminate the need for both the troublesome condensation product and the N,N'-dimethyldithio-oxamide in the composition described in U.S. Pat. No. 3,679,588. The hydraulic fluid of the present invention is the only hydraulic fluid which is accepted as meeting all of the performance specifications of MIL-H-24430A (SHIPS) by the Qualified Product List Section, Department of Defense Standardization Program and Document Branch, Ship Systems Engineering and Design Department.

SUMMARY OF THE INVENTION

The present invention is a hydraulic fluid composition comprising (a) a major proportion of a hydrocarbon oil having a viscosity of from about 10 to about 200 centistokes at 100°F., and (b) a minor proportion comprising four additive components. The first such additive component is from about 0.3 to about 3.0 weight percent in said hydrocarbon oil of a metal sulfonate having a total base number of from about 5 to about 80 and a molecular weight of from about 400 to about 1500. Preferably, the hydraulic fluid composition contains from about 0.5 to about 2.0 weight percent in said hydrocarbon oil of the metal sulfonate having a total base number of from about 35 to about 65 and a molecular weight of from about 800 to about 1,500. Preferably, the metal of the metal sulfonate is selected from the group consisting of barium, calcium, magnesium, sodium, potassium, and lithium; and more preferably, the metal sulfonate is a calcium alkaryl sulfonate having a total base number of from about 40 to about 60 and a molecular weight of from about 900 to about 1,200 and is present at a level of from about 0.75 to about 1.25 weight percent.

The second such additive component is from about 0.05 to about 0.60 volume percent in said hydrocarbon oil of a higher molecular weight alkyl- or alkenyl-substituted succinic acid or anhydride containing from about 50 to about 90 carbon atoms. Preferably, the hydraulic fluid composition contains from about 0.10 to about 0.30 volume percent in said hydrocarbon oil of the higher molecular weight substituted succinic acid or anhydride containing from about 60 to about 80 carbon atoms.

The third such additive component is from about 0.01 to about 0.50 volume percent in said hydrocarbon oil of a lower molecular weight alkyl- or alkenyl-substituted succinic acid or anhydride containing a total of from about 12 to about 34 carbon atoms. Preferably, the hydraulic fluid composition contains component is from about 0.01 to about 0.10 volume percent in said hydrocarbon oil of the lower molecular weight substituted succinic acid or anhydride containing from about 16 to about 34 carbon atoms and more preferably from about 20 to about 28 carbon atoms.

The fourth such additive component is from about 0.02 to about 0.60 volume percent in said hydrocarbon oil of an ethoxylated fatty alcohol or alkylphenol, having an HLB of from about 7 to about 15 and having the formula $R—(OCH_2CH_2)_n—OH$, wherein R is an oil-soluble group selected from the class consisting of a first alkyl group having from about 8 to about 30 carbon atoms and an alkaryl group having a total of up to 36 carbon atoms and having only one aromatic ring and from 1 to 3 second alkyl groups wherein at least one of said second alkyl groups contains from about 8 to about 30 carbon atoms, and $n$ is about 4 to about 70. Preferably, the hydraulic fluid composition contains from about 0.05 to about 0.20 volume percent in said hydrocarbon oil of the ethoxylated fatty alcohol or alkylphenol. Preferably, R is an oil-soluble group selected from the class consisting of a first alkyl group having from about 8 to about 18 carbon atoms and an alkaryl group having a total of up to about 18 carbon atoms and having only one 1 aromatic ring and from 1 to 3 second alkyl groups wherein at least one of said second alkyl groups contains from about 8 to about 12 carbon atoms.

Preferably, the hydraulic fluid composition of this invention also contains a fifth additive component of from about 0.2 to about 0.6, and more preferably from about 0.2 to about 0.4, volume percent in said hydrocarbon oil of a hindered hydrocarbylphenol. Preferably, this hindered hydrocarbylphenol is selected from the group consisting of 2,6-di-tert-butylphenol; 2,6-di-tert-butyl-4-methylphenol; 2,6-di-tert-butyl-4-n-butylphenol; 2,4,6-tri-tert-butylphenol; 2,4,6-tri-iso-propylphenol; 2,6-di-tert-butyl-4-dodecylphenol; 4,4'-methylenebis-(2,6-di-tert-butylphenol); 4,4'-methylenebis-(6-tert-butyl-2-methylphenol); 4,4'-thiobis-(6-tert-butyl-2-methylphenol); tetrakis-[methylene-3-(3',5'-di-tert-butyl-4'-hydroxyphenyl) propionate] methane; and octadecyl-3-(3',5'-di-tert-butyl-4'-hydroxyphenyl) propionate.

Preferably, the hydraulic fluid composition of this invention also contains a sixth additive component of from 0 to about 0.7 and more preferably from about 0.3 to about 0.5, volume percent in said hydrocarbon oil of a paraffin wax-naphthalene condensation product.

DETAILED DESCRIPTION OF THE INVENTION

The hydraulic fluids of the present invention consist of a hydrocarbon lubricating oil containing a combination of additives that cause the fluid to be capable of readily forming a tight sea water-in-oil emulsion when agitated in the presence of sea water and that are stable against hydrolysis at elevated temperatures that may occur during use of the fluid. The additive combination provides compatability with sea water to prevent the formation of insoluble deposits and to overcome corrosive effects to aluminum, brass, copper, iron or steel, silver, or other metals which may be present in the hydraulic system. The oil and additives of the present invention have a minimal effect on rubber seals and good oxidative stability without formation of deposits, whether dry or in the presence of water or sea water, and also maintain a stable emulsion without excessive viscosity increase or impairment of filter-ability for continued performance of the fluid after contamination with water. The viscosity of the hydraulic fluid of the present invention is dependent upon the specific power transmission requirements and is generally in the range of about 10–200 centistokes at 100°F.

Natural and synthetic lubricating oils suitable for use in the hydraulic fluids of this invention are highly refined, commercially available oils having viscosities in the range of about 10 centistokes (about 58.9 SUS) to about 200 centistokes (about 927 SUS) at 100°F. The oils used in this invention may be prepared by methods well known to those skilled in the art, including solvent extraction, catalytic hydrogenation, acid treating and clay percolation. The appropriate base oil(s) is readily selected and blended in accordance with the desired functional viscosity of the hydraulic fluid. In order to meet the viscosity requirements of MIL-H-24430A (SHIPS), the finished oil must have a viscosity of 5.3–6.7 centistokes (43.6–48.1 SUS) at 210°F. and a viscosity less than 3,000 centistokes (13800 SUS) at 0°F.

All the base oils employed in the examples presented herein meet the specifications of MIL-H-24430 (SHIPS). The compositions and properties of the base oils employed in most of the examples presented herein are as follows: X— a blend of 5 volume percent of transformer oil and 95 volume percent of solvent-extracted, dewaxed and hydrogenated SAE-10 Midcontinent oil, which gave a finished hydraulic fluid having a viscosity of 5.58 centistokes at 210°F. and 37.0 centistokes at 100°F.; Y— a blend of 50 volume percent of solvent-extracted, dewaxed and hydrogenated SAE-10 Midcontinent oil and 50 volume percent of solvent-extracted, dewaxed and hydrogenated SAE-20 Midcontinent oil, which gave a finished hydraulic fluid having a viscosity of 7.23 centistokes at 210°F. and 55.8 centistokes at 100°F., Z— 99 volume percent of a solvent-extracted, dewaxed and hydrogenated SAE-20 Midcontinent oil and 1 volume percent of a solution of 80 weight percent of a polybutene, having a molecular weight of about 2100, to 20 weight percent of a solvent-extracted, dewaxed SAE-5 Midcontinent oil, which gave a finished hydraulic fluid having a viscosity of 9.38 centistokes at 210°F. and 85.2 centistokes at 100°F. Each base oil employed in the examples presented hereinbelow contained approximately 0.3 weight percent of 2,6-di-tert-butyl-4-methylphenol. Such hindered phenol served as an anti-oxidant.

Hydrocarbon oils normally separate rapidly when mixed with distilled, tap, or salt water and allowed to stand. Such oils provide little protection from rust or corrosion to metal surfaces. However, the addition of from about 0.3 to about 3.0 weight percent of natural or synthetic metal sulfonate provides protection against rusting and corrosion of metal surfaces by sea water, and causes the water to be taken up into the oil in the form of a water-in-oil emulsion. Suitable metals in the metal sulfonates include, barium, calcium, magnesium, sodium, potassium, and lithium. Preferably, the metal sulfonate is a calcium sulfonate. Suitable sulfonic acids include those derived from a suitable aromatic petroleum fraction and synthetic products derived from benzene or naphthalene alkylated with a paraffin wax derivative, or an ethylene, propylene, or butylene polymer alkylate. Suitable metal sulfonates typically have molecular weights in the range of from about 400 to about 1500 and a total base number in the range of from about 5 to about 80. The effect of the concentration of metal sulfonate on emulsion characteristics is shown for several metal sulfonates in Table 1.

In Table 1, A is a sodium petroleum sulfonate which has an molecular weight of about 480 and a total base number of about 0 and is supplied as a mineral oil solution containing 40 weight percent of A in the mineral oil. B is a calcium petroleum sulfonate which has an molecular weight of about 1010 and a total base number of about 15 and is supplied as a mineral oil solution containing 42 weight percent of B in the mineral oil. C is a calcium synthetic sulfonate which is made from benzene, alkylated with a polypropylene having an average molecular weight of about 280, which has an molecular weight of about 920 and a total base number of about 0, and which is supplied as a mineral oil solution containing 40 weight percent of C in the mineral oil. D is a calcium petroleum sulfonate which has an molecular weight of about 994 and a total base number of about 25, and which is supplied as a mineral oil solution containing 45 weight percent of D in the mineral oil.

In each case illustrated in Table 1, a particular amount of a particular metal sulfonate was dissolved in a standard base oil having a viscosity of 6.77 centistokes at 210°F. Forty milliliters of the resulting solution was stirred with 40 milliliters of synthetic sea water at 130°F. for 5 minutes in the test apparatus and according to the test procedure of ASTM D-1401, except that synthetic sea water was used instead of distilled water. This test is part of the specifications for MIL-H-24430A (SHIPS). The emulsion was observed, and the measurements were made after the solution had stood for 1 hour at 130°F. In each case, a water-in-oil emulsion formed. The amounts of oil, free water and emulsion which separated after standing for one hour at 130°F. were measured and are indicated in Table 1 as milliliters of free oil/milliliters of free water/milliliters of emulsion under the heading of Emulsion Stability. The specifications for MIL-H-24430A (SHIPS) require that a water-in-oil emulsion be formed and that the upper limits of free oil and free water that separate after standing for 1 hour at 130°F. are 4 milliliters and 0 milliliters, respectively.

Rust inhibitors protect ferrous metals from attack by sea water either by forming a protective film on the metal surface or by sequestering the water in an emulsion. In the latter case, rust protection requires maintenance of a tight emulsion. Metal sulfonates are well known to the art to serve as effective rust inhibitors by sequestering the water in an emulsion.

The concentration of the metal sulfonate used in the present invention is determined primarily by the need for oxidation and emulsion stability and rust protection. While increasing the concentration of the metal sulfonate improves emulsion stability and rust protection, it also reduces the oxidation stability of the fluid in use and in laboratory tests. Therefore, it is necessary to keep the amount of metal sulfonate to a minimum and to add supplemental additives to increase the stability and tolerance of the emulsion and to provide additional rust inhibition.

TABLE 1

| Example | Base Oil | Metal Sulfonate | Concentration of Metal Sulfonate[1] | Emulsion Stability[2] | MIL-H-24430A Specifications |
|---|---|---|---|---|---|
| 1 | Y | A | 0.8 | 2/4/74 | Fail |
| 2 | Y | A | 1.6 | 1.5/0.5/78 | Fail |
| 3 | Y | A | 3.2 | 1/0/79 | Pass |
| 4 | Y | B | 0.32 | 1.5/32/46.5 | Fail |
| 5 | Y | B | 0.63 | 1.5/19/59.5 | Fail |
| 6 | Y | B | 1.26 | 2/10/68 | Fail |
| 7 | Y | C | 0.20 | 4/0+/76 | Fail |
| 8 | Y | C | 0.40 | 8/0+72 | Fail |
| 9 | Y | C | 0.80 | 5/0/75 | Fail |
| 10 | Y | C | 1.20 | 3/0/77 | Pass |
| 11 | X | D | 0.11 | 8/4/68 | Fail |
| 12 | X | D | 0.22 | 3/0.5/76.5 | Fail |
| 13 | X | D | 0.45 | 2/0.5/77.5 | Fail |
| 14 | X | D | 0.90 | 1.5/0+/78.5 | Fail |
| 15 | X | D | 1.80 | 1.5/0/78.5 | Pass |

[1]The concentration is the weight of the metal sulfonate in the base oil.
[2]Milliliters of free oil/milliliters of free water/milliliters of emulsion.

For this purpose, mono- and polycarboxylic acids and their acyl derivatives, having oil-solubilizing, long-chain hydrocarbon groups, are useful. Such acids and their acyl derivatives are surfactants which find use in hydraulic oils as rust inhibitors, and in some cases, as both rust inhibitors and emulsifiers. Such acids and their acyl derivatives can also shift the HLB of an emulsion to increase the tolerance of the emulsion to minor changes in acidity, salinity, and/or oil-water ratio.

The HLB is a numerical value assigned to each emulsifier in the Atlas HLB System. The Atlas HLB System is a published system for emulsifier selection and is well known to those in the emulsifier art. The entire description of the Atlas HLB System in "The Atlas HLB System" published by Atlas Chemical Industries, Inc. in Wilmington, Del. in 1963, is specifically incorporated herein by reference.

The HLB of an emulsifier is an expression of its Hydrophile-Lipophile Balance — that is, the balance of the size and strength of the hydrophilic (water-loving or polar) and lipophilic (oil-loving or non-polar) groups of the emulsifier. All emulsifiers consist of a molecule that combines both hydrophilic and lipophilic groups.

An emulsifier which is lipophilic in character is assigned a low HLB number (below 9.0) and one that is hydrophilic is assigned a high HLB number (above 11.0). Those in the range of 9–11 are intermediate. An HLB value can be calculated or estimated by various means for any emulsifier. When two or more emulsifiers are blended, the resulting HLB of the blend can be easily calculated.

The HLB of an emulsifier or blend of emulsifiers is an excellent indication of what the emulsifier system actually does, that is, whether it will make an oil-in-water emulsion or a water-in-oil emulsion, or act as a solubilizer for some oil. The HLB of an emulsifier class or blend is also an indication of the efficiency of chemically-related emulsifiers or of a blended pair of emulsifiers for performing any given emulsifier task.

When a variety of chemical types of emulsifiers is classified according to structure, each class covers a segment of the HLB range. HLB is not an indication of the efficiency of one class relative to another. Efficiency is related more to chemical structure (that is, whether the emulsifier is a soap, a partial ester, a complete ester, whether the lipophilic group is saturated, etc.), and the relationship of its chemical structure to the chemical structure of the material to be emulsified.

The carboxylic acids and anhydrides which are used in the present invention and which contain less than about 34 carbon atoms, tend to form a protective hydrophobic film on a metal surface and serve as effective rust inhibitors in hydraulic oils. The higher molecular weight carboxylic acids or anhydrides which are used in the hydraulic fluid of this invention and which contain more than about 50 carbon atoms, also serve as rust inhibitors, but additionally form water-in-oil emulsions. Preferred carboxylic acids and their derivatives are long-chain alkyl- or alkenyl-succinic acids or anhydrides.

The effects of concentration and molecular weight on the efficiency of hydrocarbon-substituted succinic acids and anhydrides as emulsifiers in hydrocarbon base oil A were determined using the procedure hereinabove mentioned and are shown in Table 2. In Table 2, F is a $C_{70}$ alkenyl-succinic anhydride, and G is a $C_{12}$ alkenyl-succinic acid. The results shown in Table 2 indicate that the addition of 0.05–0.3 volume percent of an alkenyl-succinic acid or anhydride containing 70 carbon atoms to a hydrocarbon oil containing 1.0 weight percent of the metal sulfonate solution D identified hereinabove reduces the tendency for separation of an emulsion.

The rust preventive characteristics of hydraulic fluid compositions containing the metal sulfonates and higher and lower molecular weight succinates of this invention were measured using the thirty-day on-off rust test which is described in MIL-H-24430A (SHIPS) and which employs the ASTM D-665 method, material, and apparatus, except as described hereinafter. A stirrer was used as described in ASTM D-665 but with an auxiliary blade attached to the stirrer shaft. The auxiliary blade was made of stainless steel and was located as specified under "Procedure for Heavier Than Water Fluids" in ASTM D-665. The dimensions of the auxiliary blade are specified in ASTM D-655. The specimen was polished and attached to the holder using a 1/16 -inch thick, ½-inch diameter polytetrafluoroethylene gasket between specimen and holder. After the 30 minute soaking period, 150 milliliters of the 300-milliliter fluid sample was removed, and 150 milliliters of sea water was added. The sea water was added dropwise from a burette while stirring. The burette tip was just above the surface of the fluid. The sea water was added within 30 minutes. The oil and water sample was stirred for 15 minutes after the addition of sea water was complete. The sample was stirred for 15 minutes, once every 24 hours. After 24 hours, and once weekly thereafter, the fluid level was observed to determine the amount of water loss. Distilled water was added at this time to make up for water lost by evaporation. The test period was 30 days. Quadruplicate determinations were made. A fluid is considered to have satisfactory rust protection if three out of the four specimens show no rust, and no more than light rust is observed on the fourth specimen after 30 days. If free water or inhibitor-poor oil separates during the 23.75 hour settling period each day, rusting can occur.

TABLE 2

| Example | Supplemental Emulsifier | Concentration of Supplemental Emulsifier[1] | Emulsion Time[2] | Emulsion Stability[3] |
|---|---|---|---|---|
| 16 | — | — | 102 | 25/16/39 |
| 17 | F | 0.1 | 119 | 5/0/75 |
| 18 | F | 0.3 | 115 | 8/0/72 |

TABLE 2-continued

| Example | Supplemental Emulsifier | Concentration of Supplemental Emulsifier[1] | Emulsion Time[2] | Emulsion Stability[3] |
|---|---|---|---|---|
| 19 | G | 0.05 | 107 | 3/1/76 |
| 20 | F and G | 0.2 and 0.05 | 107 | 8/3/69 |

[1]Volume percent.
[2]Time in seconds for the emulsion to be formed.
[3]Milliliters of free oil/milliliters of free water/milliliters of emulsion.

The results of these tests are shown in Table 3. In each example shown in Table 3, the metal sulfonate D, described hereinabove, was employed except where otherwise indicated. L is a calcium synthetic sulfonate having an equivalent weight of about 1000 and a total base number of 22 and is supplied in a mineral oil solution containing 44 weight percent of L. M is a mixture of 97 weight percent of metal sulfonate D and 3 weight percent of an overbased calcium synthetic sulfonate having an equivalent weight of about 1000 and a total base number of 300 and is supplied in a mineral oil solution containing about 50 weight percent of M. The higher molecular weight succinic acid anhydride F, described hereinabove, was used in each example in Table 3. The lower molecular weight succinic acid G, described hereinabove, was used in each example in Table 3, except where otherwise indicated. S is an alkylated succinic acid reacted with an amine to form an imide type condensation product wherein the alkylating group contains from 12 to 16 carbon atoms. T is a C18 alkenylsuccinic acid. The nonionic emulsifier employed in each example in Table 3 is a polyoxyethylene derivative of dinonylphenol containing from 5 to 10 moles of ethylene oxide per alkylphenol moiety, except where otherwise indicated. U is a polyoxyethylene derivative of octylphenol containing 3 moles of ethylene oxide per octylphenol moiety.

The carboxylic acid or anhydride having a relatively low molecular weight exhibits a tendency to form soft metal soaps. Generally, at sea water concentrations greater than about 7 volume percent, the water is dispersed in the oil containing such carboxylic acid or anhydride as tiny droplets having a diameter near 1 micron. However, at lower concentrations of sea water in the oil, the ratio of such carboxylic acid or anhydride emulsifier-to-aqueous phase is so high that the water droplets tend to form a soft gel-like structure. Such gel-like structures may in certain instances be problematic. Consequently, when lower levels of sea water in the oil are encountered, it is preferable to avoid such lower molecular weight succinic acids and anhydrides which have fewer than 18 carbon atoms.

TABLE 3

| Example | Base Oil | Additive Composition[7] Metal Sulfonate | High Mo. Wt. Succinate | Low Mol. Wt. Succinate | Non-ionic Emulsifier | Number of test Rods | Test Duration[6] | Test Results |
|---|---|---|---|---|---|---|---|---|
| 21 | X | .70[1] | .15 | — | — | 4 | 30 | Pass |
| 22 | Y | .70 | .15 | — | — | 4 | 30 | Pass |
| 23 | Z | .70 | .15 | — | — | 4 | 30 | Pass |
| 24 | X | .72 | .15 | — | — | 6 | 1 | 2 Pass 4 Fail |
| 25 | X | .72 | .15 | — | — | 2 | 30±1 | Pass |
| 26 | X | .72 | .15 | — | — | 2 | 2 | Pass |
| 27 | X | .72 | .2 | — | — | 2 | 1 | Pass |
| 28 | X | .9 | .15 | — | — | 2 | 1 | Fail |
| 29 | X | .9 | .2 | — | — | 2 | 1 | Fail |
| 30 | X | .74[2] | .15 | — | — | 1 | 7 | Pass |
| 31 | X | .72 | .15 | .0125 | — | 1 | 5 | Pass |
| 32 | X | .72 | .15 | .025 | — | 29 | 4–30 | 26 Pass |

TABLE 3-continued

| Example | Base Oil | Additive Composition[7] Metal Sulfonate | High Mo. Wt. Succinate | Low Mol. Wt. Succinate | Non-ionic Emulsifier | Number of test Rods | Test Duration[6] | Test Results |
|---|---|---|---|---|---|---|---|---|
| 33 | X | .72 | .15 | .05[3] | — | 2 | 24 | 3 Fail<br>1 Pass<br>1 Fail |
| 34 | X | .72 | .15 | .05 | — | 2 | 6±1 | Pass |
| 35 | X | .74[2] | .15 | .05 | — | 1 | 7 | Pass |
| 36 | X | 1.35 | .30 | .05 | — | 1 | 4 | Pass |
| 37 | & | .70[1] | .2 | — | .05[4] | 2 | 30 | 1 Pass<br>L Fail |
| 38 | X | .73 | .15 | .025 | .10 | 8 | 30 | Pass |
| 39 | X | .83 | .18 | .0275 | .112 | 2 | 12 | Pass |
| 40 | X | .83 | .18 | .055 | .112 | 2 | 12 | Pass |
| 41 | X | .83 | .17 | .0375 | .114 | 8 | 9–30 | Pass |
| 42 | X | .83 | .17 | .048[5] | .114 | 6 | 4 | Pass |

[1]The metal sulfonate is L.
[2]The metal sulfonate is M.
[3]The lower molecular weight succinate is S.
[4]The non-ionic emulsifier is U.
[5]The lower molecular weight succinate is T.
[6]Days.
[7]Weight percent.

In order to be effective, the protective oil must form stable emulsions with sea water readily. We have found that the interfacial tension between sea water and oil is a good measure of the ease of emulsion formation. Addition of a nonionic emulsifier of high hydrophilic-lipophilic balance but also of adequate hydrocarbon solubility is useful to enhance the rate of emulsion formation between oil and sea water by lowering the interfacial tension. Typical nonionic emulsifiers having an HLB of about 7–15 are ethoxylated fatty alcohols or alkyl phenols, where the lipophilic portion (R in the above formula for the ethoxylated fatty alcohol or alkylphenol) of the molecule contains at least one alkyl group having from about 12 to about 30 carbon atoms, and the hydrophilic portion of the molecule consists of about 4–20 oxyethylene groups ($n$ is 4–20). Such a compound will have an HLB of 7–15. Suitable fatty alcohols and alkylphenols include dodecanol, tetradecanol, octadecanol, octylphenol, nonylphenol, hexadecylphenol, dioctylphenol, and dinonylphenol.

The amount of non-ionic emulsifier to be used is limited by the solubility in the oil-surfactant mix and by the need to balance the package of surfactants to give a stable emulsion. Generally effective and attainable concentrations of the non-ionic emulsifiers are about 0.02–0.60 volume percent, and more commonly 0.05–0.20 volume percent.

Table 4 presents results which illustrate the effectiveness of the nonionic emulsifiers of this invention in reducing the interfacial tension and the time for complete emulsion formation (Emulsion Time) for a mixture of equal parts by volume of hydraulic fluid and sea water. Complete emulsion formation is the time after which free water no longer separates if mixing is stopped. This behavior can be measured by observing the disappearance of a thin film of water at the wall of a glass graduated cylinder stirred in an ASTM D-1401 test apparatus. The du Nouy ring method and a Cenco No. 70545 Tensiometer (Central Scientific Company) were used in each example.

Table 4

| Example | Moles of Ethylene Oxide | Interfacial Tension[1] | Emulsion Time[2] |
|---|---|---|---|
| 43 | — | 1.0–1.5 | 74 |
| 44 | 6 | 0.8–1.0 | 45 |
| 45 | 9 | 0.3–0.6 | 40 |

Table 4-continued

| Example | Moles of Ethylene Oxide | Interfacial Tension[1] | Emulsion Time[2] |
|---|---|---|---|
| 46 | 22 | — | 35 |
| 47 | 260 | — | 30 |

[1]Dynes per square centimeter.
[2]Seconds.

The blend employed in Examples 43–47 contained 1.854 weight percent of a mineral oil solution containing 45 weight percent of a calcium synthetic alkylbenzenesulfonate having an equivalent weight of 984 and a total base number of 25; 0.17 weight percent of a $C_{70}$ alkenyl-succinic anhydride; 0.05 weight percent of isooctadecylsuccinic acid; 0.316 weight percent of 2,6-di-terty-butyl-4-methylphenol; 0.151 weight percent of a paraffin wax-naphthalene condensation product and the remainder is 5.063 weight percent of transformer oil and 92.282 weight percent of hydrogenated, dewaxed, and solvent-extracted SAE-10 oil. The blend used in Examples 44–47 additionally contained 0.114 weight percent of a reaction product of 1 mole of dinonylphenol and a varying number of moles of ethylene oxide. The number of moles of ethylene oxide per mole of dinonylphenol used in each example is shown in Table 4. The nonionic emulsifier was not totally soluble in the base oil in Examples 46–47.

Highly refined petroleum oils are subject to oxidation during use, since the natural oxidation inhibitors initially present in the petroleum oils are removed during the refining process. This is indicated by a test life of less than 200 hours, as measured by ASTM D-943, Oxidation Characteristics of Inhibited Stream Turbine Oils. Service life is improved by the addition of chemical antioxidants. In order to be used effectively in high quality hydraulic oils, the antioxidants selected should not form deposits nor should they be reactive towards sea water, metals or metal alloys present in these hydraulic systems. Suitable oxidation inhibitors are those chosen from the class of hindered phenols and include: 2,6-di-tert-butylphenol; 2,6-di-tert-butyl-4-methylphenol; 2,6-di-tert-butyl-4-n-butylphenol; 2,4,6-tri-tert-butylphenol; 2,4,6-tri-iso-propylphenol; 2,6-di-tert-butyl-4-dodecylphenol; 4,4′-methylenebis-(2,6-di-tert-butylphenol); 4,4′-methylenebis-(6-tert-butyl-2,- methylphenol); 4,4'-thiobis-(6-tert-butyl-2-methylphenol); tetrakis-[methylene-3(3',5'-di-tert-butyl-4'-hydroxylphenol) propionate] methane; and octadecyl-3(3'-5'-di-tert-butyl-4'-hydroxyphenol) propionate. These oxidation inhibitors are used at a concentration level which is conventional in similar applications, for example about 0.1–1.0 volume percent. A preferred oxidation inhibitor is 2,6-di-tert-butyl-4-methyl phenol, used at a concentration of about 0.3 volume percent. When the hydraulic oil of the specific example presented above is treated with 2,6-di-tert-butyl-4-methylphenol at a concentration level of about 0.3 volume percent, the resulting hydraulic oil composition has a life of about 1,000–3,000 hours, as measured by ASTM D-943. The presence of one such hindered hydrocarbyl phenol was necessary in order for the hydraulic fluid composition of this invention to meet the specifications of MIL-H-24330A (SHIPS).

It is also useful to add a paraffin wax-naphthalene condensation product if it is necessary to lower the pour point of the fluid if it may be exposed to temperatures below the pour point of the hydrocarbon oil therein, as required in MIL-H-24330A (SHIPS).

The description of the specific additive types disclosed herein is not intended to exclude the use of other compatible additive types known to the art for inclusion in additive oils, for example, pour depressants, viscosity index improvers, foam inhibitors, and additives to reduce wear and to improve lubricity and performance under conditions of extreme pressure and the like.

We claim:

1. A hydraulic fluid composition comprising:

a. a major proportion of a hydrocarbon oil having a viscosity of from about 10 to about 200 centistokes at 100°F., and b. a minor proportion comprising:

1. from about 0.3 to about 3.0 weight percent in said hydrocarbon oil of a metal sulfonate having a total base number of from about 5 to about 80 and a molecular weight of from about 400 to about 1,500, wherein the metal in said metal sulfonate is selected from the group consisting of barium, calcium, magnesium, sodium, potassium, and lithium;

2. from about 0.05 to about 0.60 volume percent in said hydrocarbon oil of a higher molecular weight alkyl- or alkenyl-substituted succinic acid or anhydride containing from about 50 to about 90 carbon atoms;

3. from about 0.01 to about 0.50 volume percent in said hydrocarbon oil of a lower molecular weight alkyl- or alkenyl-substituted succinic acid or anhydride containing a total of from about 12 to about 34 carbon atoms; and 4. from about 0.02 to about 0.60 volume percent in said hydrocarbon oil of an ethoxylated fatty alcohol or alkylphenol, having an HLB of from about 7 to about 15 and having the formula $$R-(OCH_2CH_2)_n-OH$$

wherein R is an oil-soluble group selected from the class consisting of a first alkyl group having from about 8 to about 30 carbon atoms and an alkaryl group having a total of up to 36 carbon atoms and having only one aromatic ring and from 1 to 3 second alkyl groups wherein at least one of said second alkyl groups contains from about 8 to about 30 carbon atoms, and n is about 4 to about 70.

2. The hydraulic fluid composition of claim 1 containing from about 0.5 to about 2.0 weight percent in said hydrocarbon oil of the metal sulfonate.

3. The hydraulic fluid composition of claim 1 wherein the metal sulfonate has a total base number of from about 35 to about 65.

4. The hydraulic fluid composition of claim 1 wherein the metal sulfonate has a molecular weight of from about 800 to about 1500.

5. The hydraulic fluid composition of claim 1 wherein the metal sulfonate is a calcium alkarylsulfonate having a total base number of from about 40 to about 60 and a molecular weight of from about 900 to about 1200 and is present at a level of from about 0.75 to about 1.25 weight percent in said hydrocarbon oil.

6. The hydraulic fluid composition of claim 1 containing from about 0.10 to about 0.30 volume percent in said hydrocarbon oil of the higher molecular weight substituted succinic acid or anhydride.

7. The hydraulic fluid composition of claim 1 wherein the higher molecular weight substituted succinic acid or anhydride contains from about 60 to about 80 carbon atoms.

8. The hydraulic fluid composition of claim 1 containing from about 0.01 to about 0.10 volume percent in said hydrocarbon oil of the lower molecular weight substituted succinic acid or anhydride.

9. The hydraulic fluid composition of claim 1 wherein the lower molecular weight substituted succinic acid or anhydride contains from about 16 to about 34 carbon atoms.

10. The hydraulic fluid composition of claim 9 wherein the lower molecular weight substituted succinic acid or anhydride contains from about 20 to about 28 carbon atoms.

11. The hydraulic fluid composition of claim 1 containing from about 0.05 to about 0.30 volume percent in said hydrocarbon oil of the ethoxylated fatty alcohol or alkylphenol.

12. The hydraulic fluid composition of claim 11 containing from about 0.05 to about 0.20 volume percent in said hydrocarbon oil of the ethoxylated fatty alcohol or alkylphenol.

13. The hydraulic fluid composition of claim 1 wherein R is an oil-soluble group selected from the class consisting of a first alkyl group having from about 8 to about 18 carbon atoms and an alkaryl group having a total of up to about 18 carbon atoms and having only one aromatic ring and from 1 to 3 second alkyl groups wherein at least one of said second alkyl groups contains from about 8 to about 12 carbon atoms.

14. The hydraulic fluid composition of claim 1 containing additionally from about 0.2 to about 0.6 volume percent in said hydrocarbon oil of a hindered hydrocarbyl phenol.

15. The hydraulic fluid composition of claim 14 containing from about 0.02 to about 0.4 volume percent in said hydrocarbon oil of the hindered hydrocarbyl phenol.

16. The hydraulic fluid composition of claim 14 wherein the hindered hydrocarbyl phenol is selected from the group consisting of 2,6-di-tert-butyl-butylphenol; 2,6-di-tert-butyl-4-methylphenol; 2,6-di-tert-butyl-4-n-butylphenol; 2,4,6-tri-tert-butylphenol; 2,4,6-tri-isopropylphenol; 2,6-di-tert-butyl-4-dodecylphenol; 4,4'-methylenebis-(2,6-di-tert-butylphenol);

4,4'-methylenebis-(6-tert-butyl-2-methylphenol); 4,4'-thiobis-(6-tert-butyl-2-methylphenol); tetrakis-[methylene3-(3',3'-di-tert-butyl-4'-hydroxyphenyl) propionate] methane; and octadecyl-3-(3',5'-di-tert-butyl-4-hydroxyphenyl) propionate

17. The hydraulic fluid compositon of claim 14 containing additionally from about 0 to about 0.7 volume percent in said hydrocarbon oil of a paraffin wax-naphthalene condensation product.

18. The hydraulic fluid composition of claim 17 containing from about 0.3 to about 0.5 volume percent in said hydrocarbon oil of the paraffin wax-naphthalene condensation product.

* * * * *